United States Patent [19]

Kuyper et al.

[11] 4,274,469

[45] Jun. 23, 1981

[54] OPERATOR FOR A SLAT SHADE ASSEMBLY

[75] Inventors: Herman S. Kuyper, Knoxville; Robert S. Evers; John Regal, both of Pella, all of Iowa

[73] Assignee: Rolscreen Company, Pella, Iowa

[21] Appl. No.: 955,709

[22] Filed: Oct. 30, 1978

[51] Int. Cl.[3] ..... E06B 3/32

[52] U.S. Cl. ..... 160/107

[58] Field of Search ..... 160/107, 180

[56] References Cited

U.S. PATENT DOCUMENTS

| | | | |
|---|---|---|---|
| 2,490,295 | 12/1949 | Fisher | 160/107 |
| 2,889,591 | 6/1959 | Pratt | 160/107 |
| 3,366,159 | 1/1968 | Arnold et al. | 160/107 |
| 3,722,572 | 3/1973 | Hall | 160/107 |
| 3,985,174 | 10/1976 | Bricker | 160/180 |

FOREIGN PATENT DOCUMENTS

| | | | |
|---|---|---|---|
| 781767 | 4/1968 | Canada | 160/107 |

*Primary Examiner*—Peter M. Caun

*Attorney, Agent, or Firm*—Allegretti, Newitt, Witcoff & McAndrews

[57] ABSTRACT

An operating mechanism for a slat shade assembly of the type mounted between a pair of glazing panels of a window. The mechanism includes a sash and a pair of glazing panels which are supported by the sash. A slat shade is operatively positioned in the space between the glazing panels. An operating mechanism is secured to the surface of the window sash frame and is located between the two glazing panels. The operating mechanism is operatively connected to a selected portion of the slat shade assembly for moving the slats of the slat shade assembly between two extreme positions. An opening is provided in one of the glazing panels in a position which is adjacent to the slat shade operating mechanism. A manual control member is mounted on the one glazing panel and passes through the opening in the one glazing panel. The manual control member is operatively interconnected to the operating mechanism so that the slat shade may be moved to a desired position by the manual control member.

10 Claims, 10 Drawing Figures

Fig. 7
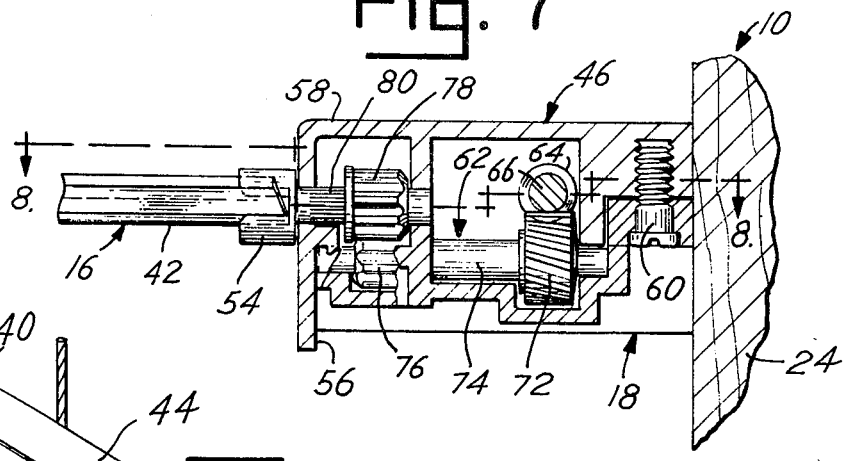
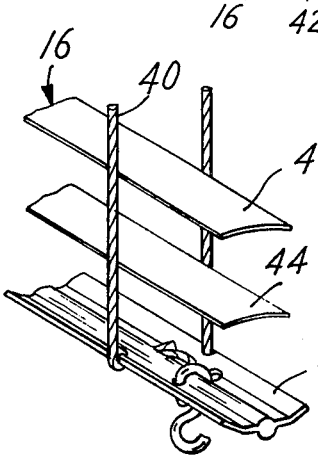
Fig. 10
Fig. 8
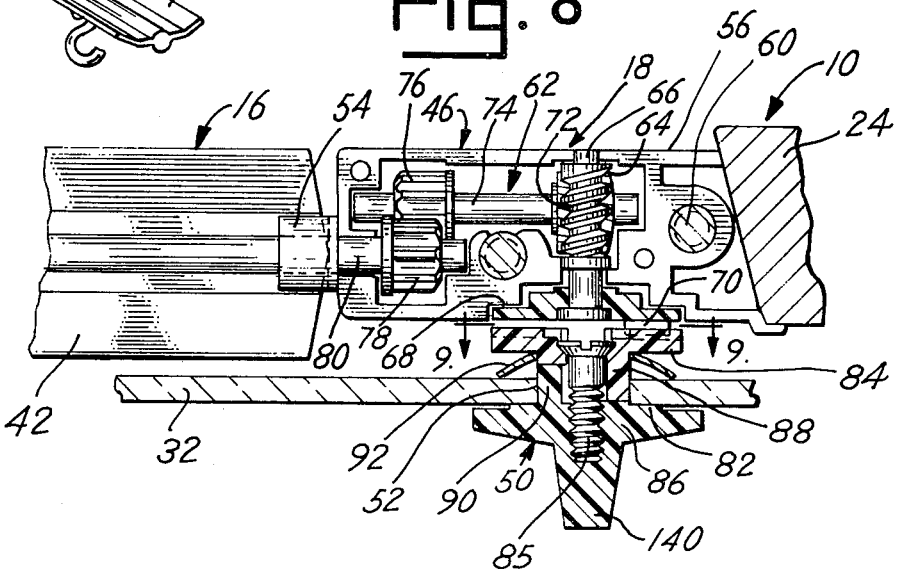
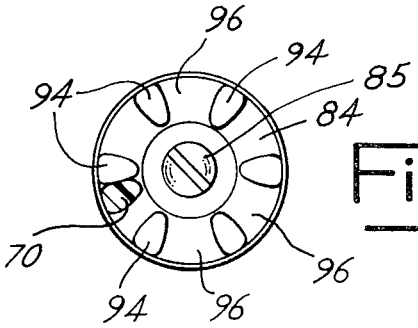
Fig. 9

OPERATOR FOR A SLAT SHADE ASSEMBLY

BACKGROUND OF THE INVENTION

Field of the Invention and Description of the Prior Art

This invention relates to an improved mechanism for operating a slat shade assembly of the type that is located between a pair of glazing panels of a window construction.

There are known window constructions which utilize a slat shade or "blind" as part of the window construction itself. One such construction (sold under the trademark SLIMSHADE) comprises a blind assembly having thin, narrow slats mounted on a cord ladder. The blind or slat assembly is positioned between two glass panels, one being an exterplor glass or glazing panel and the other being an interior glass or glazing panel so as to thereby form an insulated, double glazed window. It has been conventional, in such a construction, to provide an operating dial for adjusting the blind assembly between its various positions, such as for privacy and for sun control, such as, in the summer to prevent undue heat load and, in the winter, to permit sunlight to add heat to a room. These slat shade—double glazing panel window constructions are available for use in various types of window constructions, including double hung and casement windows. In addition, screens may be mounted on the interior side of the window frame and the slat shade is still operated.

Although the known mechanisms for operating the known slat shades have been of generally satisfactory construction, these known operating mechanisms have required routing of the wood sash and the operating mechanism can be installed in the routed-out space in the window sash and then covered by an escutcheon. Again, although, in the original manufacture of the assembly, this can be accomplished, such an assembly was difficult to accomplish in a field installation.

Also, in the known operating mechanisms for the slat shades, a direct drive was provided, which only allowed for approximately 90 degrees of movement of the slats between the extreme positions. The direct drive also limited the ability of the drive mechanism to resist the spring force generated by the cord ladder system carrying the slats and it would often be difficult to maintain the slats in the desired position. The operators also generally utilized a thumb wheel which was somewhat difficult to operate and often became painted and was difficult to move after painting to thereby destroy the advantage of the assembly itself. Because of these disadvantages of the known operators for the slat shade it would clearly be highly desirable to provide an improved operating mechanism for a slat shade assembly of the type which is located between the glazing panels of a window construction.

One known prior art system using a magnetic drive system is shown in U.S. Pat. No. 3,722,572. However, the lack of a positive drive connection is considered a significant disadvantage.

SUMMARY OF THE INVENTION

It is therefore an important object of the present invention to provide an improved mechanism for operating the slats of a slat shade assembly, that is, for moving the slats between their two extreme, rotated positions, such as the fully opened and the fully closed positions.

It is also an important object of the present invention to provide an improved operating mechanism for a slat shade assembly-double glazed window construction which is easily installed, both in manufacturing and in the field.

It is a further object of the present invention to provide an improved operating mechanism for a slat shade assembly mounted in a double glazed window wherein the drive mechanism for moving the slats between the extreme positions is a positive drive, provides for greater than 90 degrees of movement of the slats and also substantially prevents the slats and the "spring" of the cord assembly from driving the slats in a backward direction.

It is still another object of the present invention to provide an improved operating mechanism for driving a slat shade assembly wherein an operating mechanism may also be conveniently provided on a removable screen for operating the assembly.

It is still another object of the present invention to provide an improved operating mechanism for a slat shade-double glazed window assembly wherein the mechanism is particularly characterized by its simplicity and economy of construction, manufacture and use.

Further purposes and objects of the present invention will appear as the specification proceeds.

The foregoing objects are accomplished by providing an improved mechanism for operating a slat shade assembly of the type which is located between two glazing panels of a window sash wherein the mechanism includes a window sash frame, first and second glazing panels being supported by the window sash frame, a mounting surface defined on the window sash frame between the glazing panels, a slat shade operatively carried by the window sash frame between the glazing panels and being movable between first and second positions, a mechanism secured directly onto the surface of the window sash frame and being operatively interconnected to a selected portion of the slat shade for moving the slat shade assembly between first and second positions, an opening provided in one glazing panel adjacent the mechanism, and a manual control member operatively mounted on the one glazing panel and passing through the opening in the panel for operative connection with the operating mechanism, the control member being manually accessible from the side of the glazing panel opposite that of the space containing the slat shade assembly.

BRIEF DESCRIPTION OF THE DRAWINGS

One particular embodiment of the present invention is illustrated in the accompanying drawings, wherein:

FIG. 7 is a sectional view of the interior of the drive mechanism for the slat shade assembly, as taken along the line 7—7 of FIG. 4;

FIG. 8 is a sectional view taken along the line 8—8 of FIG. 7, also illustrating the drive mechanism for the slat shade assembly;

FIG. 9 is a view taken along the line 9—9 of FIG. 8 illustrating the driving portion of the manual control knob of the operating mechanism; and FIG. 10 is a pictorial view illustrating a portion of a slat shade assembly.

DETAILED DESCRIPTION OF THE PREFERRED EMBODIMENT

Figure 1:
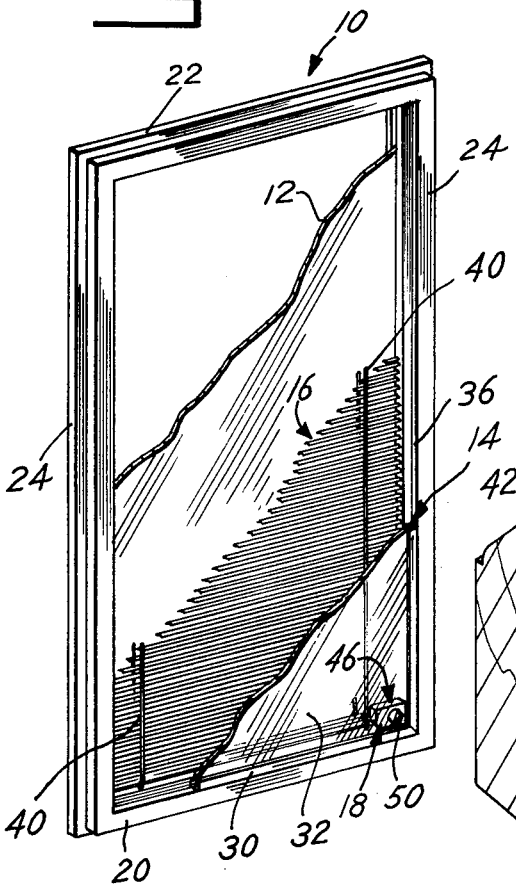
FIG. 1 is a pictorial view of our improved operating mechanism for the slat shade assembly.

Referring to FIG. 1, a window sash, generally 10, of the casement type, preferably being made of wood, is shown in pictorial view. The window sash 10 is double-glazed and includes an exterior glazing panel 12 and an inner glazing panel 14. A slat shade assembly, generally 16, is operatively supported within the sash 10 between the two glazing panels 14. An improved operating mechanism, generally 18, manually operable from the inner side of the inner glazing panel 14, is provided for operating the slat shade assembly 16, that is, for pivoting the slat shade assembly 16 between its two extreme positions. Although in the embodiment shown, our improved operating mechanism 18 is shown used with a casement window, the mechanism 18 may also be utilized in connection with other types of window constructions, including double hung windows.

In a conventional manner, the casement window sash is pivotally carried within a window frame of a conventional type. Again, in a convention manner, a suitable operating mechanism (not shown) is provided for cranking the sash 10 between the open and closed positions relative to the frame. Such an opening mechanism is well known and forms no part of the present invention.

Figure 2:
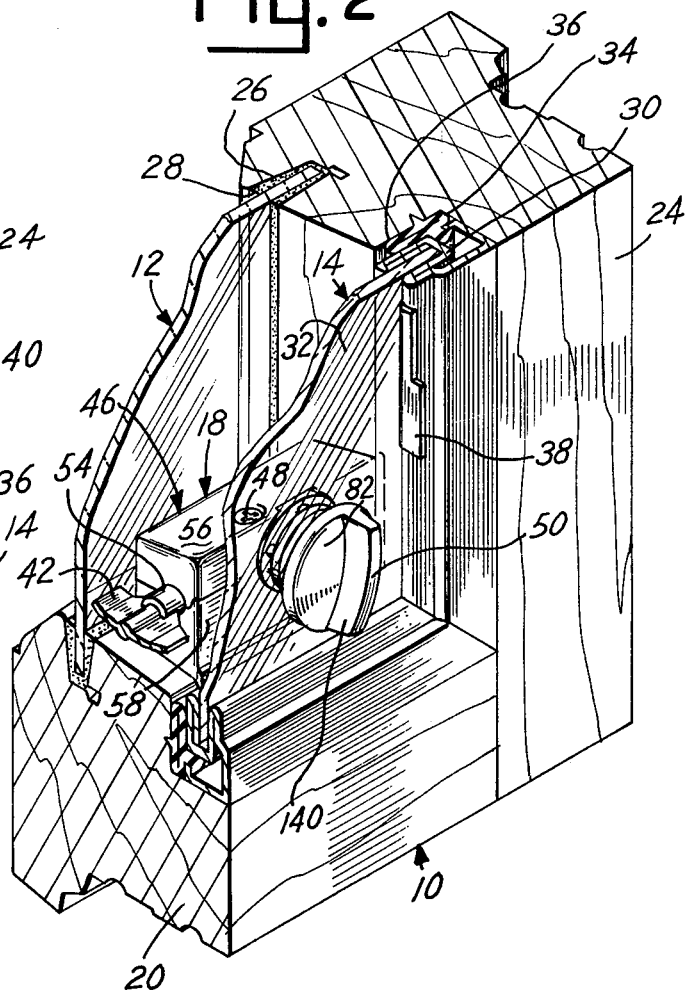
FIG. 2 is an enlarged detailed view of the operating mechanism on the sash frame and on one of the glazing panels of the window construction illustrated in FIG. 1.

Referring to FIGS. 1 and 2, the window sash 10 includes a bottom rail 20, an upwardly spaced top rail 22, and a pair of laterally spaced upright stiles 24 which rigidly interconnect the bottom rail 20 to the top rail 22. As seen in FIG. 2, the exterior glazing panel 12 is secured within a rabbet 26 defined in the inner periphery of the rails 20 and 22 and stiles 24. The exterior glass 12 is sealably embedded, along its outer periphery, within a sealing material 28 within the rabbet 26. The interior glazing panel 14 is separately mounted in the sash 10 and comprises a frame 30 which carries a glass panel 32 within a sealant 34. The frame 30 is removably carried on the inside of the sash 10 within a peripheral groove 36 in the rails 20 and 22 and stiles 24. A plurality of locks 38 are provided on the frame 30 for securing the inner glazing panel assembly 14 within the sash 10.

Referring to FIGS. 1 and 10, the slat shade assembly 16, which is of generally convention construction, includes a plurality of spaced cord ladders 40 which support a bottom slat 42, an upwardly spaced top slat (not shown) and a plurality of equally spaced narrow slats 44 which are positioned between the top and bottom slats. Suitable hardware (not shown) suspends the slat shade assembly 16 between the top rail 22 and bottom rail 20 of the sash 10. The slat shade assembly 16 is pivoted by operation or pivoting movement of the bottom slat 42, which thereby moves the remaining slats about their horizontal axes in order to control the position of the slat shade assembly 16 for sun control, privacy or the like.

As seen best in FIGS. 2, 4, 7 and 8, the operating mechanism 18 is operatively interconnected to the bottom slat 42 for rotation of the bottom slat 42 and thereby, through the cord ladders 40, the remaining slats 44 and top slats are moved for the same desired degree of rotation.

Referring to FIG. 2, the operating mechanism 18 for the slat shade assembly 16 includes a housing 46 which is rigidly secured to the outer periphery or surface of the bottom rail 20. The housing 46 is secured in place by a single wood screw 48, which passes through a suitable passage in the housing and which is rigidly received within the bottom rail 20. The housing 46 is located in the space defined between the glazing panels 12 and 14. The slat shade assembly operating mechanism 18 further includes a manual control section 50 which is pivotally carried within an opening 52, as seen in FIG. 8, which is provided in the inner glass panel 32. The housing 46 encloses a drive mechanism, to be hereinafter described in greater detail, which operates a laterally extending coupler 54 which securely engages one end of the bottom slat 42 of the slat shade assembly 16.

Referring to FIGS. 7 and 8, it is seen that the housing 46 includes first and second sections 56 and 58. The housing sections 56 and 58 are secured together by a screw 60 which passes through an aperture provided in the first housing section 56 and is threadably received in an opening in the second housing section 58. As previously described, a screw 58 passes through the housing 46 to secure the housing 46 to the sash 10. The housing 46 defines a chamber within which a drive mechanism 62 is operatively positioned.

The drive mechanism 62 includes a worm gear 64 which is carried on a shaft 66 which is securely and rotatably mounted in a direction which is substantially normal to the glazing panels 12 and 14. The inner end of the shaft 66 is rigidly secured to a coupler half 68 which faces inwardly towards the glazing panel 14. The coupler half 68 includes a drive lug 70, as best seen in FIG. 9. The outer or opposite end of the worm gear shaft 66 is rotatably mounted in the outer wall of the housing 46.

The worm gear 64 is mounted above and meshes with a gear 72 which is fixed on a rotatable, transverse shaft 74. The shaft 74 is mounted at substantially right angles to the worm gear shaft 66 and is rotatably carried, at its opposite ends, within the housing 46. A gear 76 is spaced outwardly of the gear 72 and is also fixed to the shaft 74. The gear 76, in turn, operatively meshes with a gear 78 mounted on a stub shaft 80 which is parallel to the shaft 74, but spaced therefrom. The stub shaft 80 is rotatably mounted in the housing 46. The outer end of the stub shaft 80 is secured to the coupler 54 which operatively engages the bottom rail 42 of the slat shade assembly 16, as previously described.

The manual control 50 passes operatively through the opening 52 provided in the inner glazing panel 14. The manual control 50 generally comprises a knob which may be conveniently grasped in the fingers for rotation. The manual control 50 is rotatably received within the opening 52 in the glass panel 14 and the inner face of a flange 82 defined on the control 50 extends beyond the outer periphery of the opening 52 so as to assist in substantially maintaining the air space within the chamber defined between the exterior glass 12 and the inner panel 14.

A drive plate 84 is fixedly secured to the manual control 50 by a screw 85 which passes through the drive plate 84 inwardly into an aperture provided in the manual control portion 86 of the manual control mechanism 50. The drive plate 84 includes an inwardly extending coupler section 88 which is non-rotatably secured to a complementary coupler section 90 provided in the manual control section 86 of the manual control mechanism 50. A biasing spring 92 is provided in order to bias the inner face of the flange 82 against the portion of the glass surrounding the opening 52 in the glass panel 14. As seen in FIG. 9, the outer face of the drive plate 84 includes a plurality of lugs 94 having a plurality of spaces 96 defined therebetween. The drive lug 70 of the coupler half 68 is located in any one of the spaces 96 between any pair of lugs 94, in the assembled condition. In this way, as the manual control section 88 is rotated, the rotary movement is imparted to the drive plate 84. Since the drive lug 70 is located between the lugs 94, the rotary motion is transmitted to the worm gear 64. Also the relative, locked position between the coupler 68 and drive plate is conveniently accomplished by the described construction.

The slat shade operating mechanism 18 provides a direct drive between the manual control 86 and the slat shade coupler 54 so as to provide for a positive driving force therebetween, as opposed to prior art devices, such as that shown in the Hall U.S. Pat. No. 3,722,572 wherein a magnetic drive is provided between a manual control and the slat shade operator. The direct drive arrangement is made possible through the use of an opening 52 provided in the glass panel 14 which was found to be without any significant adverse effect on the insulating air space provided between the glazing panels 12 and 14. This is made possible, in part, by the biasing of the flange 82 of the manual control section 86 against the outer periphery of the glass surrounding the opening 52 in the glass. The arrangement for mounting the operating mechanism 18 directly to the sash 10 without requiring routing out of the wood together with the provision of the aperture 52 in the glass panel 14, provides for a very simple installation, whether the installation is made in the field or in a plant.

The drive mechanism 62, by using the worm-gear-spur gear arrangement, avoids undesired reverse movement of the slat shade assembly 16 once it is positioned, which is in contrast to prior art devices. In addition, as opposed to the prior art which provided only approximately 90 degrees of slat rotational movement, the drive system 62 provides for approximately 140–160 degrees of motion about the longitudinal axes of the slats 44 that make up the slat shade assembly 16. Additionally, the control mechanism 18 is spaced from the sash 10 and thereby does not become painted, which can adversely affect the operation of the mechanism. Finally, the positioning of the drive lug in the spaces 96 between the lugs 94 on the drive plate 84 relative to the coupler 68 accomodates for misalignment between the two parts as the inner panel 14 may be removed in the conventional manner for cleaning purposes, for working on the slat shade assembly or the like.

Figure 3:
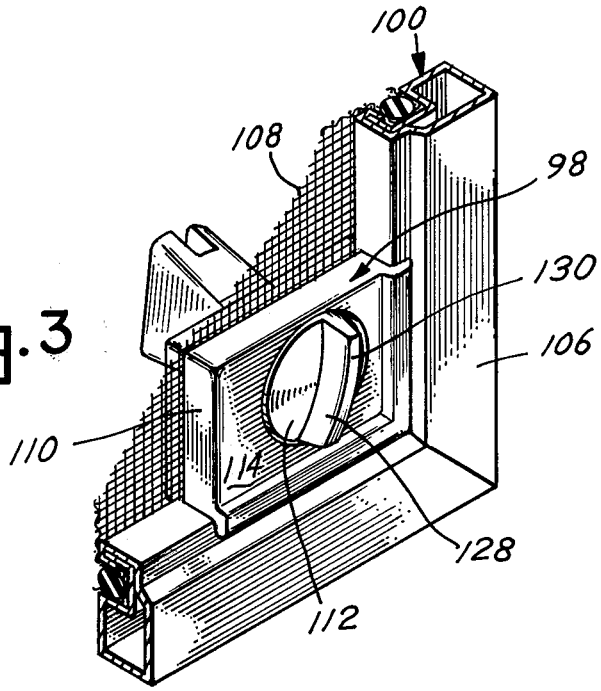
FIG. 3 is an enlarged pictorial view of a screen, which may be mounted on the interior side of a window frame and which includes an operating mechanism for interconnection to the operating mechanism which drives the slat shade assembly.
Figure 4:
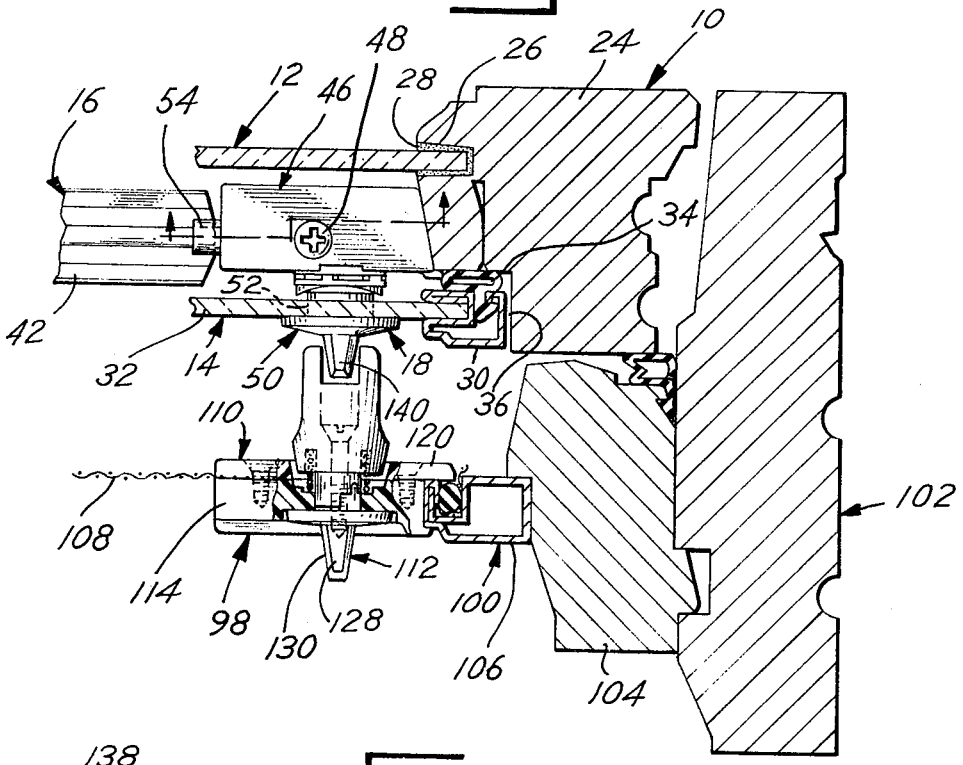
FIG. 4 is a partially sectioned, top plan view of a window construction utilizing our improved slat shade operator assembly and including an operating device mounted on an interior, removable screen.
Figure 5:
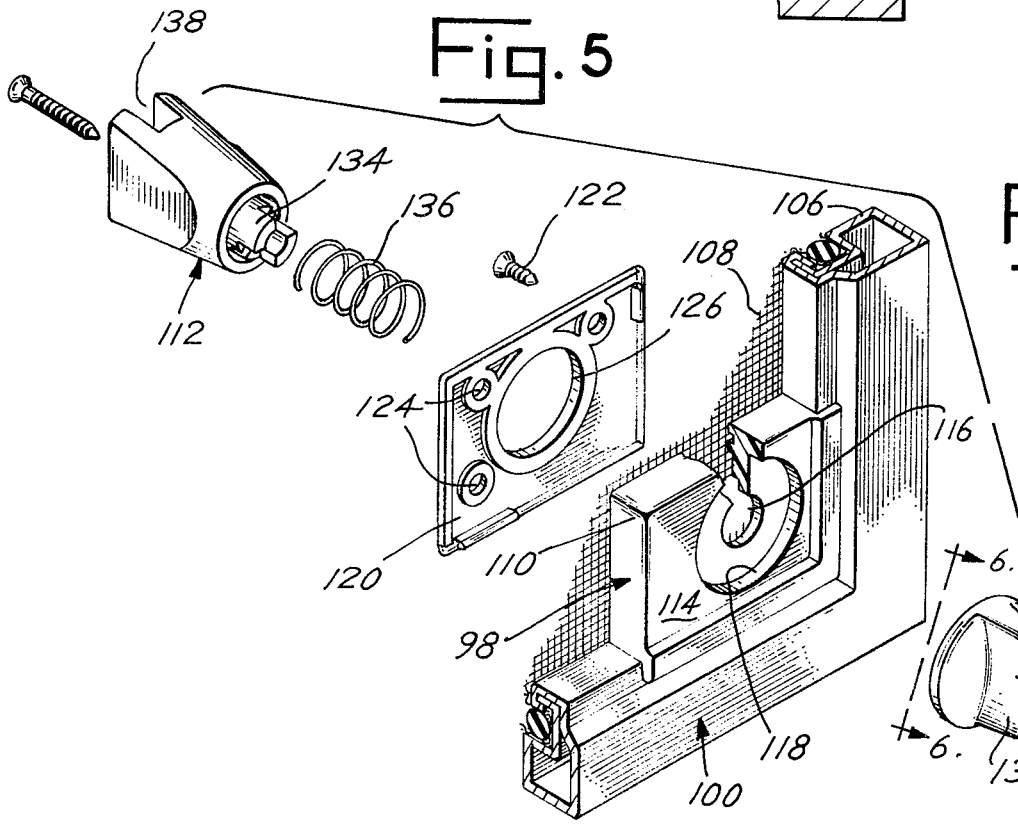
FIG. 5 is an exploded view of the portion of a slat shade operator assembly provided on a screen.

An additional advantage of the operating mechanism 18 is that it readily accomodates to cooperate with a coupler assembly, generally 98 which is operatively mounted on a screen assembly 100 mounted within a window frame 102, such as a casement window, as illustrated in FIG. 4. Referring to FIGS. 3, 4, 5 and 6, it is seen that the window sash 10 is received within the frame 102 and an upright jamb 104 of the window frame has the screen assembly 100 rigidly secured therein, as during summertime.

The screen assembly 100 generally includes a frame 106 which is constructed and arranged to be received within the window frame 102 and includes a screen cloth 108 which is secured within the frame 106 in a conventional manner. As seen in FIG. 3, the coupler assembly 98 is rigidly secured, for example, in the lower right hand corner of the screen assembly 100 for alignment with the operating mechanism 18 for the slat shade assembly 16 mounted on the sash 10 in the same general location. The coupler assembly 98, as seen in FIG. 3, generally includes a mounting section 110 and a rotatable section 112.

Figure 6:
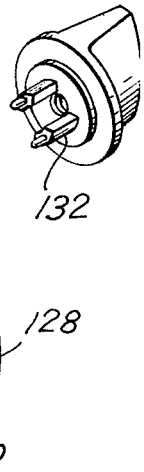
FIG. 6 is a pictorial view taken along the line 6—6 of FIG. 5 showing the coupler portion of the operating knob for use on the screen assembly of FIG. 5.

The mounting section 110 includes a rigid section 114 which is constructed and arranged to be received on the screen cloth 108 and the frame 106 of the screen. The rigid section 114 includes a central aperture 116 which is surrounded by an outer well 118. A securing plate 120 is positioned on the opposite side of the screen cloth 108 from the rigid mounting section 114 and is secured thereto by a plurality of screws 122 which pass through a plurality of apertures 124 in the securing plate 120 for passage through suitable openings in the rigid mounting section 114. The securing plate 120 also includes a central opening 126. A manual gripping section 128 having an outer finger gripping rib 130 is positioned on the inside of the rigid mounting section 114 and is rotatably received within the well 118. As seen in FIG. 6, the gripping section 128 includes an outwardly extending coupler 132 for non-rotatable securement to a connecting section 134 to the manual control mechanism 50 of the operating mechanism 18.

The connecting section 134 is rigidly secured to the manual gripping section 128 by a screw which passes centrally through the connecting section 134 and is received within an aperture in the gripping section 128. A compression spring 136 biases the gripping section 128 outwardly so that it bears firmly against the annular surface defined within the well 118.

The connecting section 134 includes an outwardly facing central transverse groove 138 which is constructed and arranged to cooperatively engage a rib 140 provided on the manual control section 86 of the manual control section 50 of the slat shade operating mechanism 18. Substantial clearance is provided between the groove 138 and the rib 140 so as to accomodate for any undesired misalignment. In addition, the natural spring of the screen frame 106 accommodates for any additional misalignment between the screen coupler 98 and the manual control mechanism of the operating mechanism 18. In this way, when a sash 10 is opened or closed relative to the window frame 102 of the casement window and the groove 138 is not in precise alignment with the rib 140 on the manual control mechanism 50, the screen frame 106 bows while keeping connecting section 134 against rib 140 until rotation of section 112 aligns the groove 138 with the rib 140, at which time the rotatable section 112 is firmly coupled to the manual operator 50. Thus, it is seen that the coupler arrangement 98 provides for an additional advantage for the operating mechanism 18 for the slat shade assembly 16 as the slat shade assembly 16 may be readily and simply operated without moving the screen.

While in the foregoing there has been provided a detailed description of one preferred embodiment of the present invention, it is to be understood that all equivalents obvious to those having skill in the art are to be included within the scope of the invention, as claimed.

What we claim and desire to secure by Letters Patent is:

1. A mechanism for operating a slat shade assembly of the type located between two glazing panels of a window sash construction, said mechanism comprising, in combination, a window sash frame, first and second glazing panels supported by said frame, said first glazing panel being removably mounted on said frame, a surface defined on said frame between said glazing panels, a slat shade assembly operatively carried by said frame between said glazing panels and being movable between first and second positions, a mechanism assembly having a coupling member operatively directly interconnected to a selected portion of one of said slat shades for moving said slat shade between said first and second positions, said mechanism assembly including a housing and a drive mechanism operatively mounted and completely contained within said housing, separate fastener means for securing said housing directly to a selected portion of said surface of said frame, said fastener means defining the sole means for sleectively mounting or removing said assembly to or from said frame, said drive mechanism including said coupling member, said drive mechanism including a gear train, said gear train being constructed and arranged for resisting undesired movement of said slat shade assembly following the positioning thereof, normally caused by spring action in said slat shade assembly, an opening in said first glazing panel adjacent said mechanism, a manual control member operatively mounted on said first glazing panel passing through said opening and having means for operative connection of said control member with said drive mechanism, said control member being accessible for manual operation from the exterior of the space defined between said glazing panels.

2. The slat shade operating mechanism of claim 1 wherein said manual control member is rotatably mounted in a direction transverse to said glazing panels and means are provided for transmitting rotary motion of said manual control member to said selected portion of said slat shade for rotary movement thereof.

3. The slat shade operating mechanism of claim 1 wherein said manual control member is spaced away from said window sash frame.

4. The mechanism of claim 1 wherein said manual control member is rotatably mounted, said selected portion of said slat shade is rotatably mounted, and said gear train transmits rotary motion from said manual control member to said selected portion of said slat shade.

5. The slat shade operating assembly of claim 1 including a screen assembly and a screen mounted manual control member for operatively and selectively engaging said manual control member.

6. The mechanism of claim 5 wherein said screen mounted control member is alignable with said manual control member and is mounted entirely on said screen assembly.

7. The mechanism of claim 5 wherein said screen mounted member and said slat shade moving mechanism are in direct alignment with each other.

8. The mechanism of claim 5 wherein said manual control member includes an inwardly projecting rib and said screen mounted member includes a groove member for selectively operatively engaging said rib of said manual control member.

9. The mechanism of claim 5 wherein said screen mounted manual control member and said manual control member on said glazing panel include cooperating rib and groove means constructed and arranged for becoming firmly coupled together by relative rotation.

10. The slat shade operating mechanism of claim 1 including operating means on said manual control member and on said moving mechanism for removably coupling said mechanism and said control member together into operative relationship.

* * * * *